United States Patent [19]

Sato

[11] Patent Number: 4,889,501

[45] Date of Patent: Dec. 26, 1989

[54] ELECTRICAL CONNECTOR

[75] Inventor: Kensaku Sato, Tokyo, Japan

[73] Assignee: Hirose Electric Co., Ltd., Tokyo, Japan

[21] Appl. No.: 323,128

[22] Filed: Mar. 13, 1989

Related U.S. Application Data

[63] Continuation of Ser. No. 96,489, Sep. 15, 1987, abandoned.

[30] Foreign Application Priority Data

Sep. 24, 1986 [JP] Japan ..... 61-244732

[51] Int. Cl.[4] ..... H01R 13/40

[52] U.S. Cl. ..... 439/595; 439/395; 439/603

[58] Field of Search ..... 439/595, 593, 596, 395, 439/603

[56] References Cited

U.S. PATENT DOCUMENTS

| | | | |
|---|---|---|---|
| 4,127,314 | 11/1979 | Hasimoto | 439/603 |
| 4,295,698 | 10/1981 | Chow | 430/595 |
| 4,387,943 | 6/1983 | Werth et al. | 439/595 |
| 4,557,543 | 12/1985 | McCleerey et al. | 439/395 |
| 4,571,017 | 2/1986 | Fujita | 439/595 |
| 4,602,836 | 7/1986 | Garretson et al. | 439/595 |
| 4,840,578 | 6/1989 | Sato | 439/395 |

FOREIGN PATENT DOCUMENTS 58-52772 4/1983 Japan .

*Primary Examiner*—P. Austin Bradley

*Attorney, Agent, or Firm*—Kanesaka & Takeuchi

[57] ABSTRACT

An electrical connector has an insulating housing having front and rear ends and a plurality of receiving apertures extending between the front and rear ends; a plurality of contacts adapted to be inserted into the receiving apertures and having a contact section for making a contact with a contact of a mating connector and a connection section to which a conductor is to be connected; a latch device for preventing the contacts from falling out of the insulating housing when said contacts are inserted into the receiving apertures beyond a predetermined distance; the insulating housing having a plurality of grooves extending along the receiving apertures for guiding a rod portion of a pulling-out tool toward the latch device; the latch device being movable to a release position by insertion of the rod portion into the groove; and each of the contacts having a piercing member with a slit into which a conductor is to be pushed for connection.

3 Claims, 4 Drawing Sheets

FIG. 12
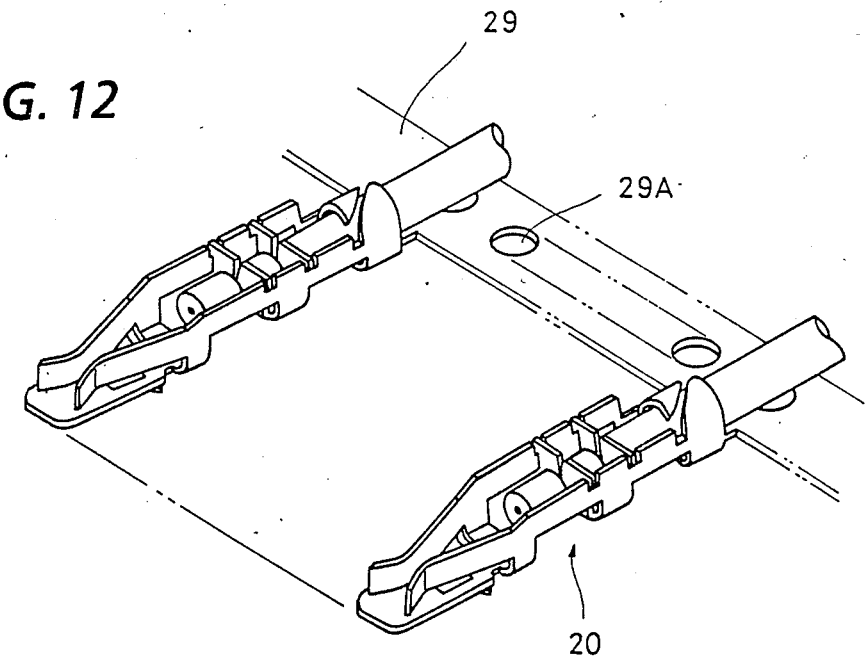
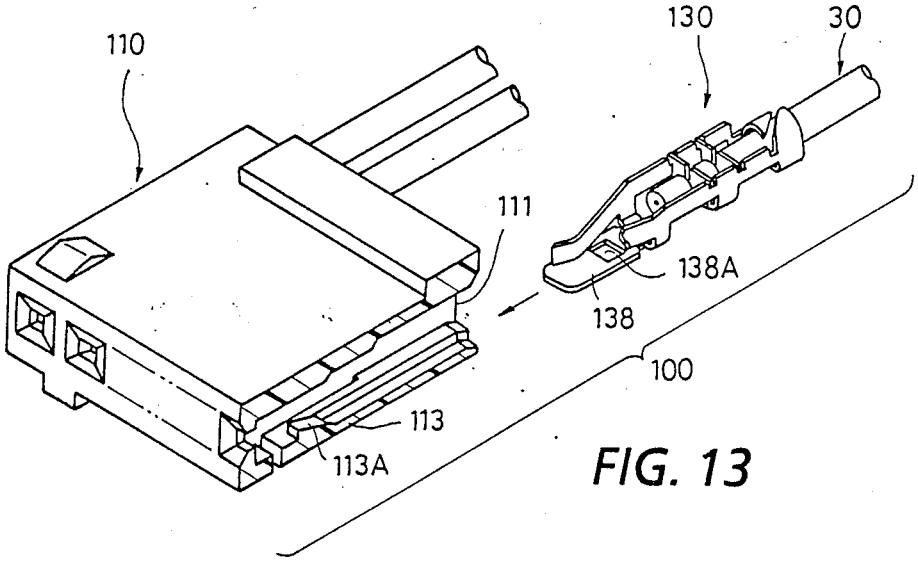
FIG. 13
FIG. 14
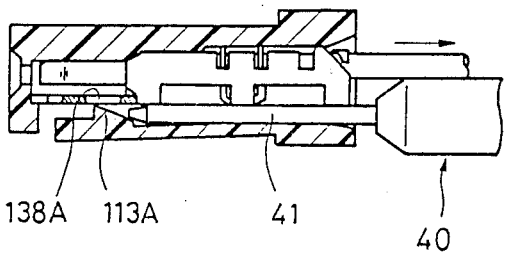

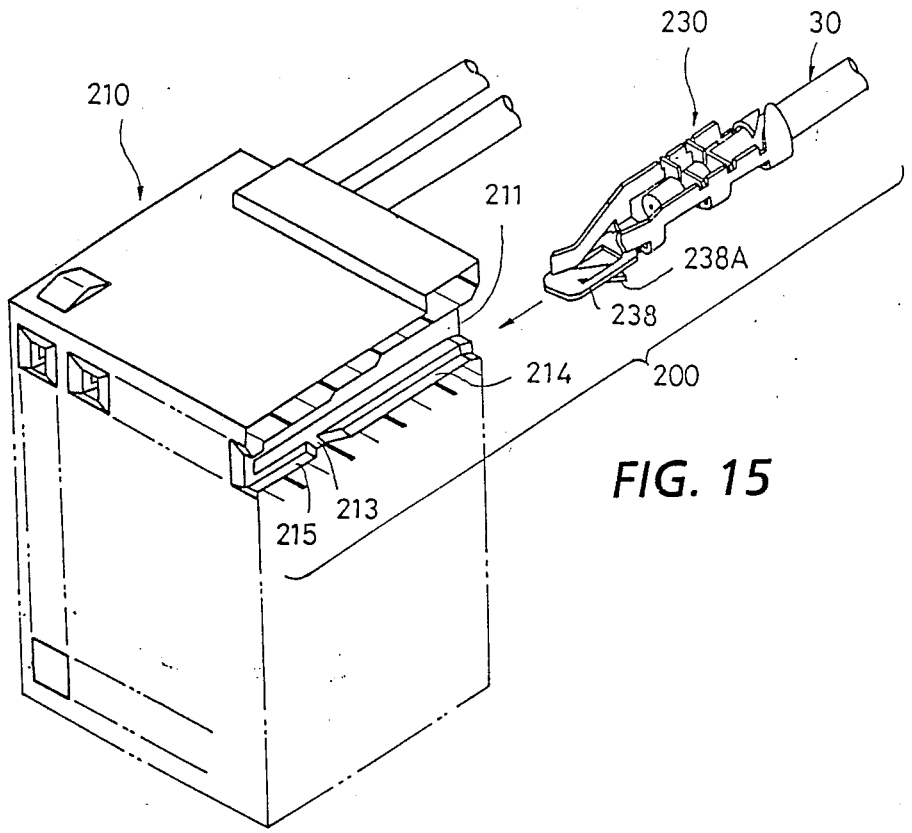
FIG. 15
FIG. 16
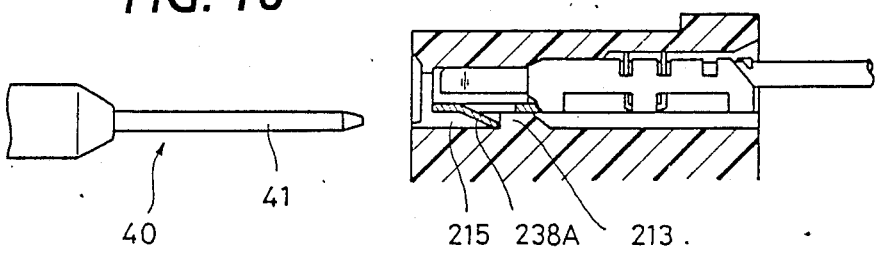
FIG. 17
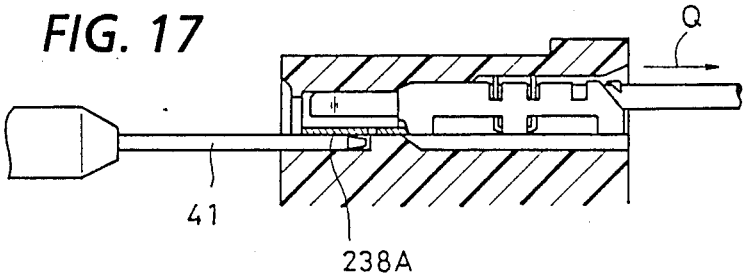

ELECTRICAL CONNECTOR

CROSS-REFERENCE TO RELATED APPLICATIONS

This is a continuation of application Ser. No. 096,489 filed Sept. 15, 1987, now abandoned.

BACKGROUND OF THE INVENTION

The present invention relates generally to electrical connectors and, more particularly, to electrical connectors having a plurality of contacts to which conductors are connected by pushing.

Japanese U.M. Patent Kokai No. 58-52772 discloses an electrical connector of he aforementioned type. in this connector, the contacts having a piercing portion to which a conductor is to be pushed for connection are fixedly mounted in an insulating housing in such a manner that they can no longer be removed. In this connection, all of the conductors are pushed into the piercing portions for connection at once. However, this connector has the following drawbacks:

(1) Since all the contacts are fixedly mounted in the connector body before connection to conductors, it is impossible to replace any contact after the connection. Consequently, when a contact is damaged, the entire connector with the conductors connected must be discarded.

(2) Since all the contacts have been mouned in the connector body, the individual contacts must be identical in specifications. As a result, the conductors to be connected to the contacts are limited to the same type and cannot be different in thickness, etc.

(3) Since a great number of conductors are pushed into the contacts mounted in the housing for connection all at once, the pushing force is so large that a large, expensive machine is required. As a result, not all of the connector users can have it conveniently.

(4) Unlike the ordinary piercing-type connector, the connector user cannot freely select the type of conductors according to the desired circuit but only can ask a harness maker for making such connection.

SUMMARY OF THE INVENTION

Accordingly, it is a primary object of the invention to provide an electrical connector from which a given contact may be replaced after it is connected to a conductor.

According to the invention there is provided an electrical connector including an insulating housing having front and rear ends and a plurality of receiving apertures extending between the front and rear ends; a plurality of contacts adapted to be inserted into the receiving apertures and having a contact section for making a contact with a contact of a mating connector and a connection section to which a conductor is to be connected; a latch device for preventing the contacts from falling out of the insulating housing when said contacts are inserted into the receiving apertures beyond a predetermined distance; the insulating housing having a plurality of grooves extending along the receiving apertures for guiding a rod portion of a pulling-out tool toward the latch device; the latch device being movable to a release position by insertion of the rod portion into the groove; and each of the contacts having a piercing member with a slit into which a conductor is to be pushed for connection.

To assemble the electrical connector, first of all, conductors are pushed into each contacts for connection one by one, eliminating the need of a large pushing force as otherwise required in the conventional method. Thus, this operation may be easily performed by using a manual tool. The contact with the conductor connected is then inserted into a receiving aperture in a housing while the latch device first resiliently deforms and then returns to its initial position to prevent the contact from falling out of the housing.

When a given contact is to be replaced, the rod of a pulling-out tool is inserted into a groove to bend the resilient latch device for release. Under this condition, the contact may be pulled out of the housing. A new contact is then inserted into the receiving aperture as described above.

Other objects, features, and advantages of the invention will be more clear from the following description taken in conjunction with the accompanying drawings.

BRIEF DESCRIPTION OF THE DRAWINGS

The accompanying drawings illustrate embodiments of the invention, wherein

FIG. 12 is a perspective view of a tie strip having a plurality of contacts to which conductors are connected;

FIG. 13 is an exploded perspective view of another embodiment of the invention, with its insulating housing shown in cross section;

FIG. 14 is a sectional view of the connector illustrating how a contact is removed;

DESCRIPTION OF THE PREFERRED EMBODIMENTS

Figure 1:
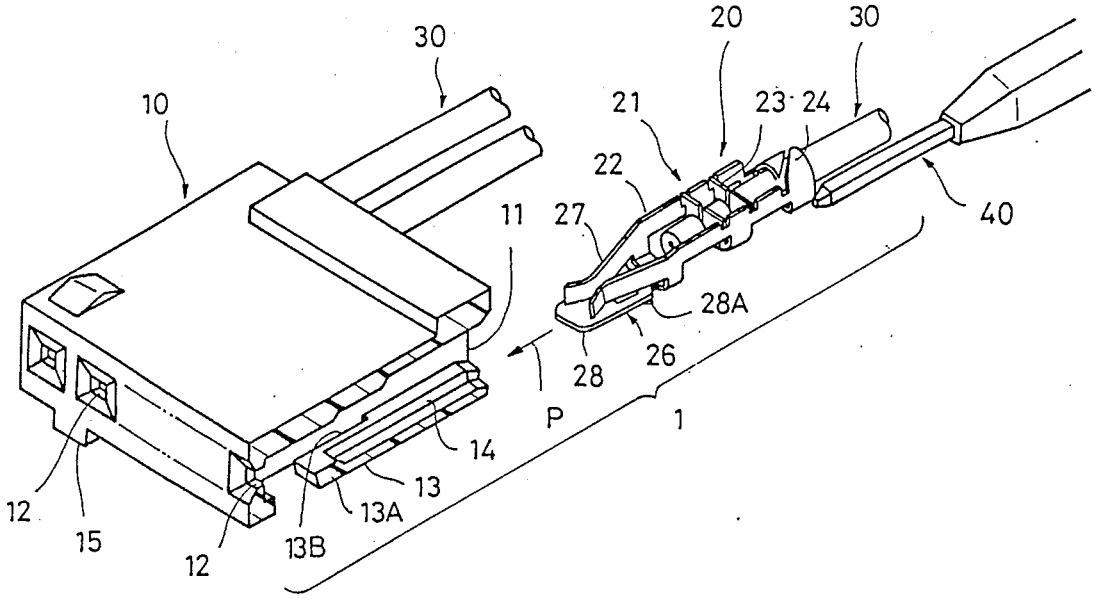
FIG. 1 is an exploded perspective view of an electrical connector according to the invention, with its insulating housing shown in cross section.

FIGS. 1–11 show an embodiment of an electrical connector 1 according to the invention. The electrical connector 1 consists of an insulating housing 10 made of a plastic or other insulating material so as to have generally rectangular front and rear ends, opposite sides, and top and bottom, and a plurality of female contacts 20, each of which is formed by stamping and bending a resilient and electrically conductive metal sheet.

The insulating housing 10 has a plurality of receiving apertures 11 extending between the front and rear ends and aligned at equal intervals across the sides. Each receiving aperture 11 has at its front end a receiving mounth 12 for receiving a male contact of a mating connector. In the middle of the receiving aperture 11 there is provided a resilient latch arm 13 for engagement with a latch tongue 28A of the contact 20, which will hereinafter be described in more detail. The latch arm 13 is defined by a U-shaped cut 13B so as to extend toward the front end and has at its free end a latch protuberance 13A with a tapered rear wall. The latch arm 13 of the housing and the latch tongue 28A of the contact constitute a latch device. The receiving aperture 11 has at its bottom a receiving groove 14 extending from the rear end for receiving the rod portion of a pulling-out tool 40. A guide rim 15 is provided on the bottom of the housing 10 to prevent its misfitting into the mating connector.

Figure 9:
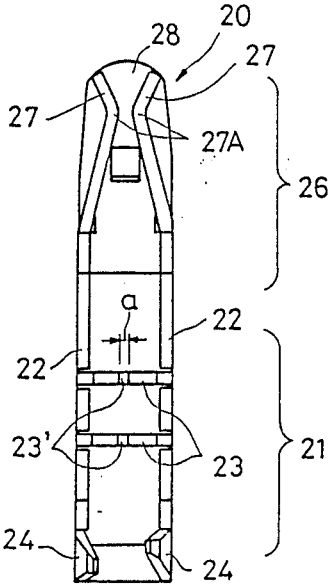
FIGS. 9–11 are front, side, and rear views of the contact.
Figure 10:
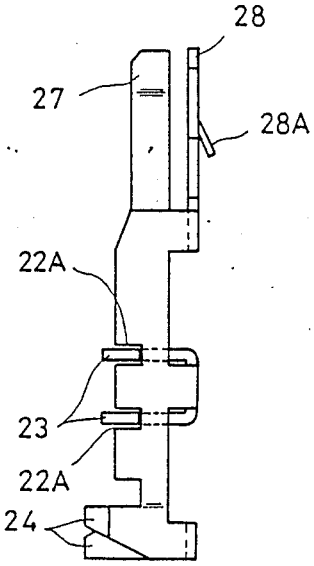
Figure 11:
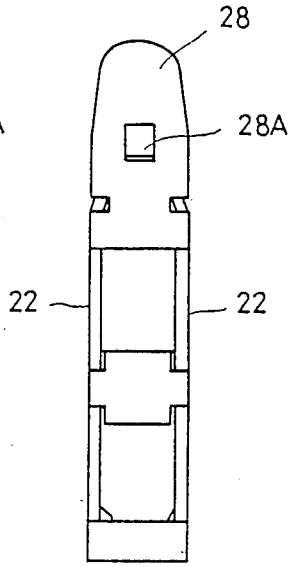

As FIGS. 9–11 show, the femal contact 20 has a connection section 21 for connection by piercing and a contact section 26 for receiving a male contact. The connection section 21 has a pair of side walls 22 between which there is provided a U-shaped piercing member 23. Each leg of the piercing member is bifurcated so as to have a slit 23' into which a conductor 30 is pushed for connection. Opposite sides of each leg are fitted into notches 22A of the side wall 22 to prevent the piercing member 23 from falling down. In the rear end of connection section 21 there is provided a pair of clamping tabs 24 to be crimped to the sheath of the conductor 30. The contact section 26 has a base portion 28 extending toward the front end and a pair of contact pieces 27 with a throat portion 27A extending substantially perpendicular to a plane of the base portion 28. The base portion 28 has a latch tongue 28a punched out downwardly.

A procedure of connecting the conductor 30 to the contact 20 and mounting it in the insulating housing 10 will be described.

(1) Conductors 30 to be connected to piercing members 23 are prepared. When the conductors are different in thickness, the contacts having the width (a) of a slit 23' suitable for each conductor are selected.

(2) The conductor 30 is pushed into the piercing member 23 with a pushing tool or machine (not shown) for connection as shown in FIG. 1. When the number of conductors to be connected is small, a conventional manual or electrical pushing tool may be used to make a connection by pushing each conductor into the slit of each contact. When many conductors are connected, it is preferred to use a conventional automatic pushing machine for connection as described below.

As FIG. 12 shows, a tie strip 29 with a large number of guide holes 29A has a large number of female contacts 20 at equal intervals. This tie strip is intermittently advanced in an automatic pushing machine at the same intervals as those of the contacts for connection by pushing conductors one by one. Alternatively, a number of contacts 20, e.g., the same number as the number of poles of a connector, may be connected by pushing them all at once. Each contact is severed from the tie strip 29 when it is connected to the conductor in the automatic pushing machine.

(3) The contacts 20 with the conductors 30 connected are then inserted into the receiving apertures 11 of an insulating housing 10. When the contact is inserted at a predetermined distance, its latch tongue 28A engages the front end of a latch arm 13 in the receiving aperture 11 to secure the contact 20 in the aperture 11, thus forming a complete electrical connector 1.

Figure 2:
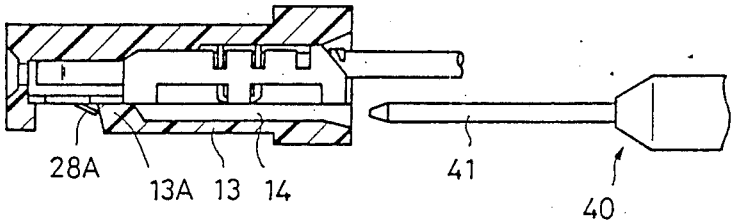
FIGS. 2 and 3 are sectional views of the connector illustrating how a contact is removed with a tool.
Figure 3:
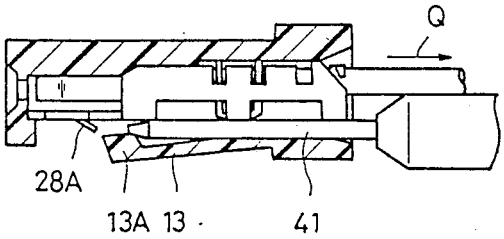
Figure 4:
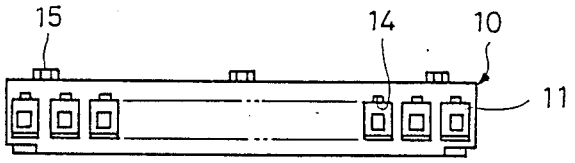
FIGS. 4–8 are rear, bottom, front, top, and side views of the insulating housing.
Figure 7:
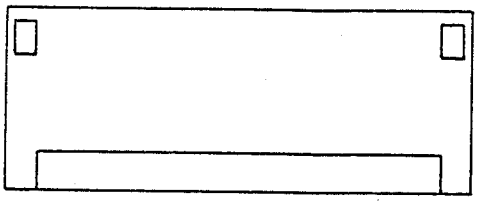
Figure 5:
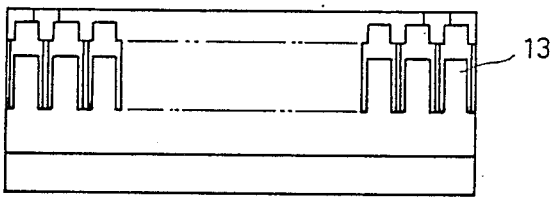
Figure 8:
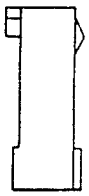
Figure 6:
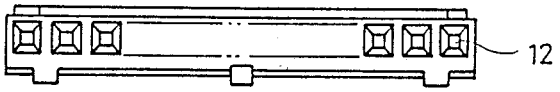

When one of the contacts 20 thus mounted becomes defective, as FIGS. 2 and 3 show, the rod portion 41 of a pulling-out tool 40 may be inserted into the groove 14 of the aperture 11 to push down the latch protuberance 13A of the latch arm 13 for release from the latch tongue 28A of the contact 20. Under this condition, the contact 20 may be easily pulled out in the direction of an arrow Q. A new contact may then be replaced in the aperture.

FIGS. 13 and 14 show another embodiment of the invention. Like the first embodiment, in this second embodiment, a housing 110 is provided with a latch arm 113 having a latch protuberance 113A at its free end. However, it is noted that the latch protuberance 113A has a sloped rear wall which is longer than that of the first embodiment. A contact 130 has a rectangular opening 138A to fit over the latch protuberance 113A. When the contact is inserted into the aperture, the front edge of its latch opening 138A engages the front end of the latch protuberance 113A to prevent falling off of the contact.

When a contact is to be replaced, in the same manner as in the first embodiment, the rod portion 41 of a tool 40 may be inserted into the groove to bend the resilient latch arm for releasing the latch protuberance 113A from the latch opening 138A (FIG. 14). Under this condition, the contact may be easily pulled out.

The electrical connector according to the invention has the following advantages.

(1) After mounted in an insulating housing, a contact may be replaced by using a simple tool, thus eliminating the need to discard the entire connector and making the maintenance easier and less costly than before.

(2) Conductors may be connected to contacts one by one so that a small manual tool may be used, thus permitting the manufacture of electrical connectors in a variety of facilities in size.

While a preferred embodiment of the invention has been described using specific terms, it is to be understood that changes and varistions may be made without departing from the spirit and scope of the invention as recited in the appended claims.

I claim:

1. An electrical connector comprising:

an insulating housing having front and rear ends and a plurality of receiving apertures each extending between said front and rear ends and having at top, a bottom, and opposing sides;

a plurality of contacts adapted to be inserted into said receiving apertures so that each contact rests on said bottom of said aperture and each having a connection section and a contact section for making a contact with a contact of a mating connector;

said contact section including a base plate extending forward and a pair of contact pieces extending forward along and above said base plate;

a cantilevered resilient latch arm defined by a U-shaped cut on said bottom of said receiving aperture so as to extend forwardly from a middle of said receiving aperture in the same plane as that of said bottom;

latch means provided on a central area of said base plate so as to engage said latch arm when said contact is inserted into said receiving aperture beyond a predetermined distance; and a receiving groove extending forwardly from said rear end of said insulating housing on said cantilevered resilient latch arm to such an extent that insertion of a rod portion of a pulling out tool into an elongated space defined by said receiving groove and a bottom of said contact releases said latch arm from said latch means.

2. The electrical connector of claim 1, wherein said latch means is a latch tongue punched downwardly from said base plate; and said latch arm is provided with a latch protuberance at its free end for engagement with said latch tongue when said contact is inserted into said receiving aperture beyond said predetermined distance.

3. The electrical connector of claim 1, wherein said latch means is a latch opening provided on said base plate; and said latch arm is provided with a latch protuberance at its free end for engagement with said latch opening when said contact is inserted into said receiving aperture beyond said predetermined distance.

* * * * *